US009016466B1

(12) United States Patent
Travis

(10) Patent No.: US 9,016,466 B1
(45) Date of Patent: Apr. 28, 2015

(54) MINE DUSTING MACHINE

(76) Inventor: Tonny Dean Travis, Prosperity, WV (US)

( * ) Notice: Subject to any disclaimer, the term of this patent is extended or adjusted under 35 U.S.C. 154(b) by 1018 days.

(21) Appl. No.: 13/065,561

(22) Filed: Mar. 24, 2011

(51) Int. Cl.
*B65G 23/04* (2006.01)
*E21B 21/00* (2006.01)

(52) U.S. Cl.
CPC ..... *E21C 7/04* (2013.01)

(58) Field of Classification Search
USPC ..... 198/860.1, 835, 833; 60/325
See application file for complete search history.

(56) References Cited

U.S. PATENT DOCUMENTS

| | | | | |
|---|---|---|---|---|
| 4,218,881 | A * | 8/1980 | Huffman et al. | 60/325 |
| 4,321,018 | A * | 3/1982 | Hurt | 417/229 |
| 5,096,045 | A * | 3/1992 | Feldl | 198/583 |
| 5,174,434 | A * | 12/1992 | Bourgoine | 198/867.13 |
| 5,372,245 | A * | 12/1994 | Mojden et al. | 198/604 |
| 5,609,238 | A * | 3/1997 | Christensen | 198/583 |
| 6,321,900 | B1 * | 11/2001 | Micklethwaite | 198/498 |
| 2012/0085624 | A1 * | 4/2012 | Wehrle | 198/674 |

* cited by examiner

*Primary Examiner* — James R Bidwell

(57) ABSTRACT

An apparatus for delivering limestone dust to the outlet of a unique dust discharge structure of a dust hopper (tank) particularly useful in dusting underground coal mine shafts wherein an air blower for pressurizing a dust/air mixture in the discharge structure is powered by a lagged roller engaged and rotatably driven by a conveyor belt and wherein the roller has ceramic tiles partially imbedded in its lagged surface.

2 Claims, 5 Drawing Sheets

MINE DUSTING MACHINE

BACKGROUND OF THE INVENTION

This invention concerns dusting device such as used in coal mines, and particularly concerns such a device which can more effectively provide low levels of dust, e.g., limestone dust, of uniform densities or solids concentrations to the mine ventilation air currents for transportation thereby over substantial distances.

In underground coal mines, large amounts of coal dust are necessarily generated by the cutting, blasting, loading, crushing and the like of the coal. This dust not only is present in high concentrations at these sites but is carried by the mine ventilation air current from these sites, as well as from belt conveyor transfer point and locations along the belt conveyor where ventilation checks are installed, throughout the mines until it settles out on down stream surfaces. Such atmospheric dust, and settled-out dust accumulations are fire and explosion hazards and must be periodically cleaned up or made inert by addition of limestone rock dust.

There are several ways in which underground coal mines generate coal dust, (1) when the coal is cut from the coal seam, (2) when the coal is loaded into equipment that takes the coal to a feeder, (3) when the feeder crushes the coal, (4) when the feeder discharges the coal onto a conveyor belt and, (5) when the coal is discharged from one conveyor belt to the next conveyor belt.

This coal dust is carried by the ventilating air stream into the return ventilation air entries where it settles out in these entries and along the conveyor belt. The dust is also carried along the belt conveyor entries by the air stream in these entries.

Federal law requires that intake entries be 65% inert, and that return entries be 80% inert. Limestone dust is spread in the intake and return entries to get the needed percentages of inertness.

Federal law also does not allow coal dust to remain on top of surfaces underground. For example, an entry could have the percent inertness required but if coal dust is on top of the limestone dust and the entry is black with coal dust, a violation of federal law could be cited.

Prior Art: To keep the return entries and belt conveyor entries white, a limestone distributor called a Trickle Duster is typically employed. These dusters have an air blower and a tank that holds limestone dust. The blower discharge air goes into the tank typically up thru the limestone dust and fluidizes the dust. A small portion of the limestone dust is carried by the air stream and is continuously discharged into the entries. The trickle duster discharges a continuous fog of limestone dust that is carried by the ventilation air and helps to keep the return entries and conveyor belt entries white. A serious problem with conventional such dusters arises from the blowing of ambient air into the limestone dust tank. Anytime air is taken underground and is warmer than the underground ambient temperature (normally 50-55° F.), a condition of 100% humidity is present. In summer months, all surfaces in an underground coal mine are wet. The air that is blown into the limestone dust is at 100% humidity and the limestone dust absorbs water during its fluidization which causes particles of the dust to become heavier and to stick together. When this limestone dust is discharged into the air stream entries, it will not travel as far and will not uniformly coat surfaces within the mine because it is wet and particles of the dust have agglomerated.

Another serious problem arises from the custom that trickle dusters are powered either by an electrical motor or by a rubber lagged roller which is in contact with and driven by the conveyor belt. Trickle dusters receiving power from a roller in contact with the conveyor belt have the problems of the lagged roller shaft breaking and of excessive lagging wear. This lagged roller typically is as long as the belt conveyor is wide. Therefore, a 60" wide belt conveyor will have a trickle duster lagged roller about 60" long at the lagging, and the supporting shaft of the lagged roller will be even longer so that end bearings can be installed.

A belt conveyor has the highest tension in the center of the belt along its longitudinal axis such that when the lagged roller is forced against the belt conveyor, the load on the lagged roller is concentrated at the center of the roller's length. This causes the roller to flex thus causing its center shaft to break and, among other problems, cause the lagging on the roller to wear rapidly in the center of its length.

SUMMARY OF THE INVENTION

The above and other problems associated with prior trickle dusters and their power sources have been essentially eliminated by: (1) structure for delivering limestone dust and pressurized air to the mine entries rapidly whereby the dust will only be exposed to the high humidity air from the ambient air from a blower for a short period of time in the delivery hose as compared to prior dusters which are designated to form dust-in-air suspensions within the dust feed hopper apparatus. The present dust will travel a greater distance in the entries since it is dry and particles of limestone dust will not be stuck together. The present mechanical means employs an auger in the bottom of a vee bottom tank, an air blower and preferably with the addition of a vibrator on at least one sloped side wall to aide in dust movement to the auger and specially designed dust discharge structure which produces a substantially dry dust-in-air discharge stream; and (2) the use of a lagged roller for powering the duster blower wherein the ratio of roller length to conveyor belt width is from about ⅙ to about ½, most preferably from about ⅓ to about ⅓, e.g., about 16 in. roller length for a 60 in. wide belt is preferred with ceramic tiles embedded in the rubber lagging. The shorter length roller will not flex like the longer one and will not break even though the roller shaft diameter is markedly reduced.

BRIEF DESCRIPTION OF THE DRAWINGS

The invention will be understood further from the drawings herein and their description wherein the figures are not drawn to scale or consistent proportions, and wherein.

DETAILED DESCRIPTION

Figures 1, 9:
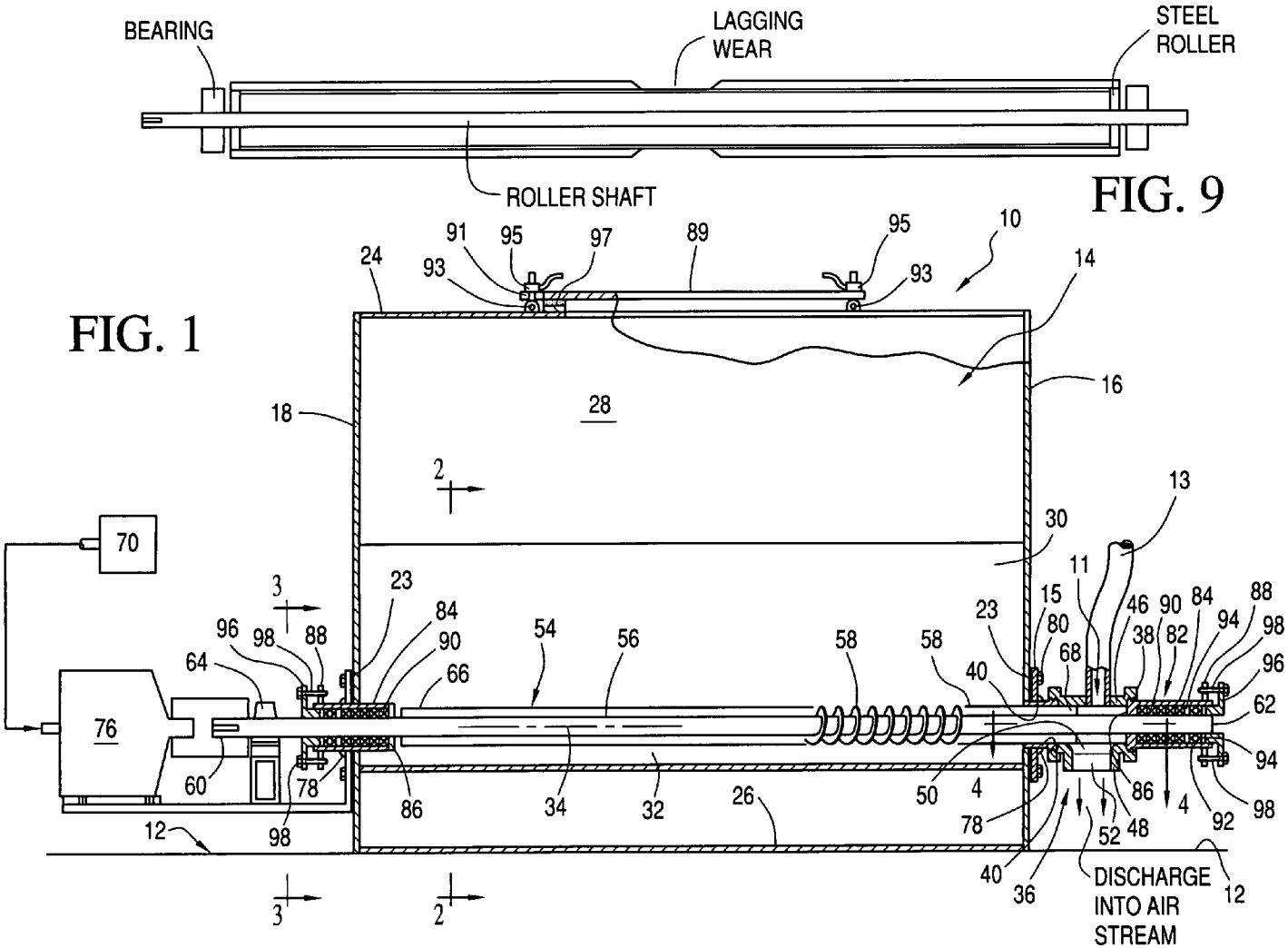
FIG. 1 is an inside view (structures substantially in proportion) of the present duster with the near side section removed and certain structures shown in cross-section.
FIG. 9 shows the lagging wear pattern of a typical full length belt powered roller.
Figure 1A:
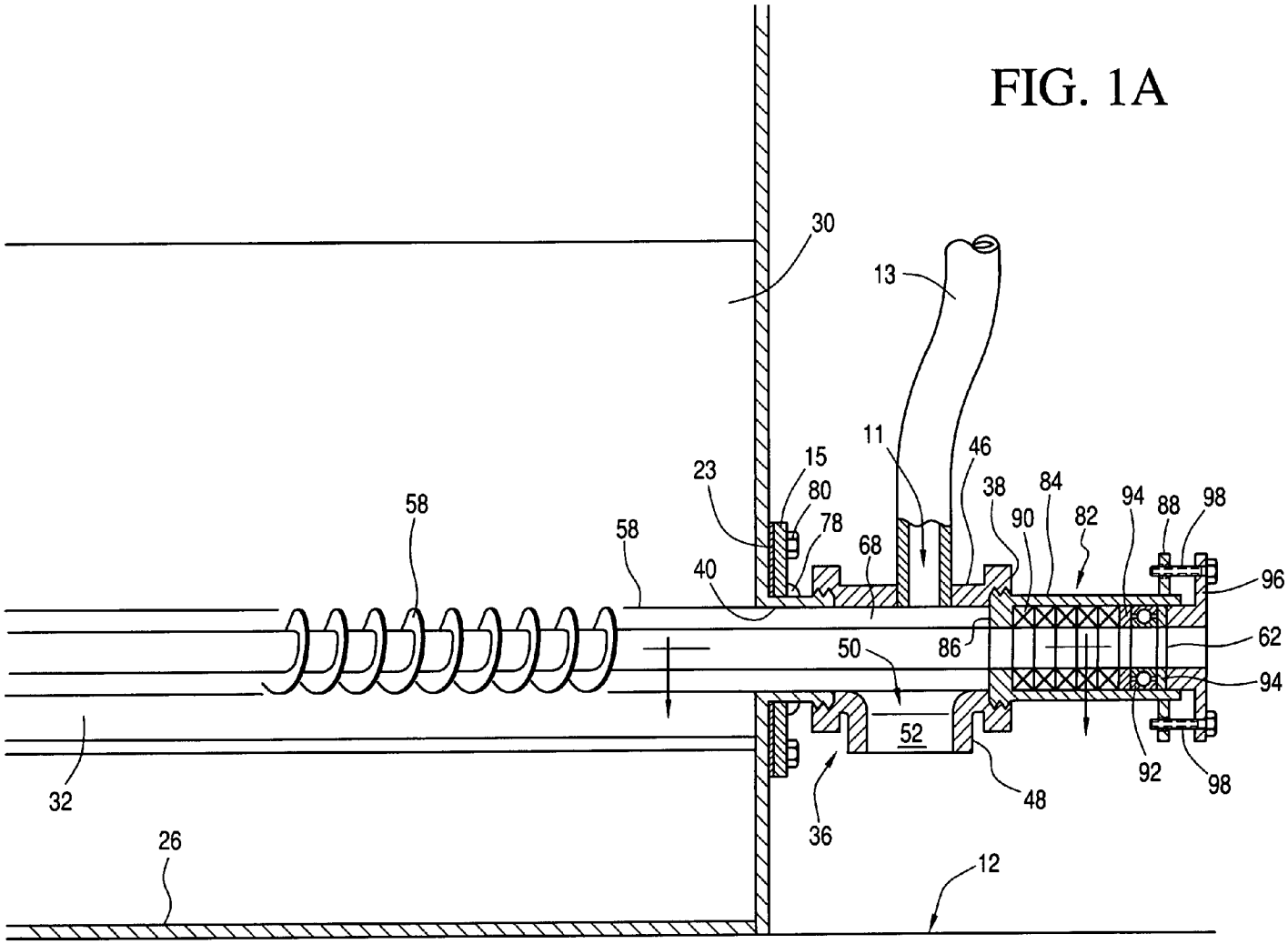
FIG. 1A is an enlarged view of the discharge side of the structure of FIG. 1.
Figure 2:
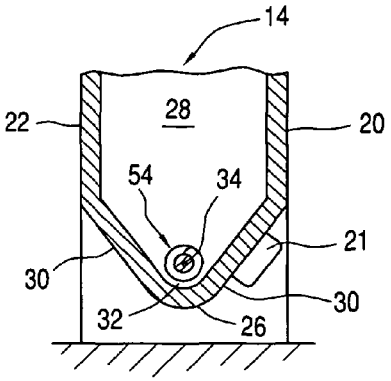
FIG. 2 is a cross-sectional view taken along line 2-2 in FIG. 1 with typical structural dimensions shown.
Figure 4:
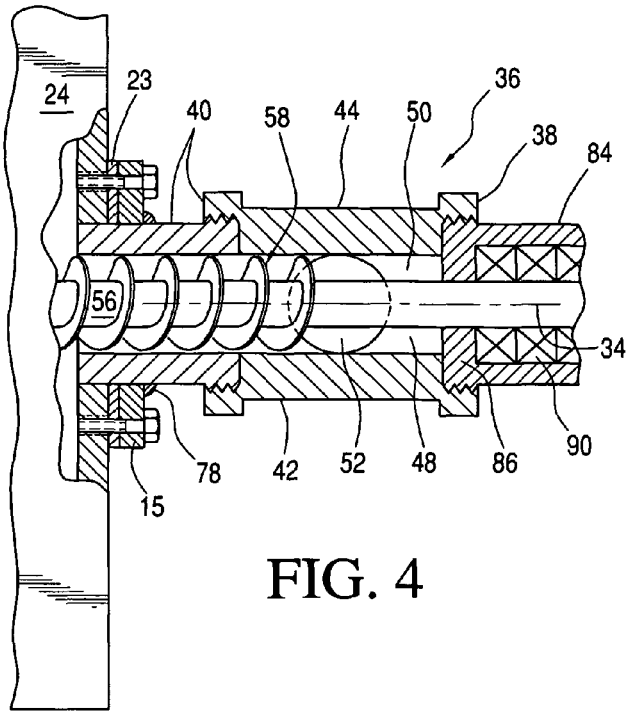
FIG. 4 is a cross-sectional view of the discharge structure and adjacent hopper structure taken along line 4-4 in FIG. 1.
Figure 3:
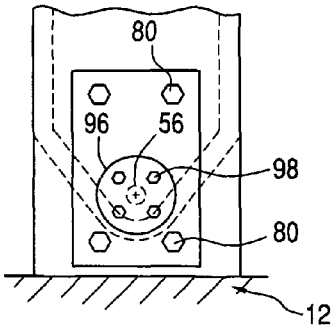
FIG. 3 is an end view of the hopper taken along line 3-3 in FIG. 1.

Referring to the drawings and with particular reference to the claims herein the trickle duster 10 comprises a base frame 12 which may be provided with wheels for easy transport, supports a dust hopper 14 formed with front 16, rear 18, side 20, 22, top 24 and bottom 26 wall sections forming a material feed chamber 28, lower portions 30 of at least one of the side sections being slanted inwardly to form an auger well 32 having a longitudinal axis 34 running thru the front and rear wall sections.

A typical vibrator 21 useful with the present invention is the "Dayton" 2P Series 6L740 giving an adjustable force, e.g., 450 lbs. at 115/230 volts, single phase at 3600 RPM shown on page 234 of GRAINGER Catalog No. 402.

A dust discharge structure 36 preferably affixed to a mounting plate 15 has a front 38, rear 40, side 42, 44, top 46 and bottom 48 wall means forming an auger discharge cavity 50 thru which axis 34 runs. This structure is mounted on front wall section 16 of the hopper via plate 15 with said rear wall means 40 of the discharge structure adjacent and sealed to front wall section 16. An air inlet port 11 is provided on structure 36 and is adapted for connection to the exhaust 74 of blower 72. A dust outlet port 52 on the discharge structure communicates with cavity 50. Plate 15 preferably is welded or the like as at 78 to 40 and is preferably bolted as at 80 to 15 such that the discharge structure can be slid off of the auger should repairs be needed.

Affixed to the front wall means 38 of the dust discharge structure is a front bearing assembly generally designated 82 and comprising a sleeve member 84 having an inner end 86 formed as a retaining shoulder and having an outer end affixed to a bolt flange 88 as part of a packing gland. Within said member 84 is sealing packing 90, bearing 92 and spacer washer 94. Packing gland flange 96 is adapted to be pressured against bearing 92 and packing 90 by bolts 98.

An auger 54 is provided having a shaft 56 supporting flight section 58, said shaft having a drive end 60 and a front end 62 and is mounted axially in well 32 with the front end extending axially thru the front wall section 16 of the hopper and thru and beyond the rear 40 and front 38 wall means of the discharge structure. End 62 is axially rotatably supported by second bearing means 92 mounted on the front wall means of the discharge structure as described above. The drive end of the shaft extends thru the rear wall section of the hopper and is rotatably supported by first bearing means 64 located exteriorly of chamber 28. A packing gland similar to that used for the front end 62 of shaft 56 receives the drive end 60 of the shaft and the equivalent parts of this gland to those at end 62 are numbered the same.

Flight section 58 has a rear end 66 and a discharge end 68, said discharge end extending axially thru the front wall section 16 of the hopper and the rear wall means 40 of the discharge structure and opens within and is adapted to discharge into discharge cavity 50. The rear end 66 of the flight section resides within the auger well. Motor 70 on the duster drives a speed reducer 76 which drives said auger. Dust seals 23 are provided.

Figure 7:
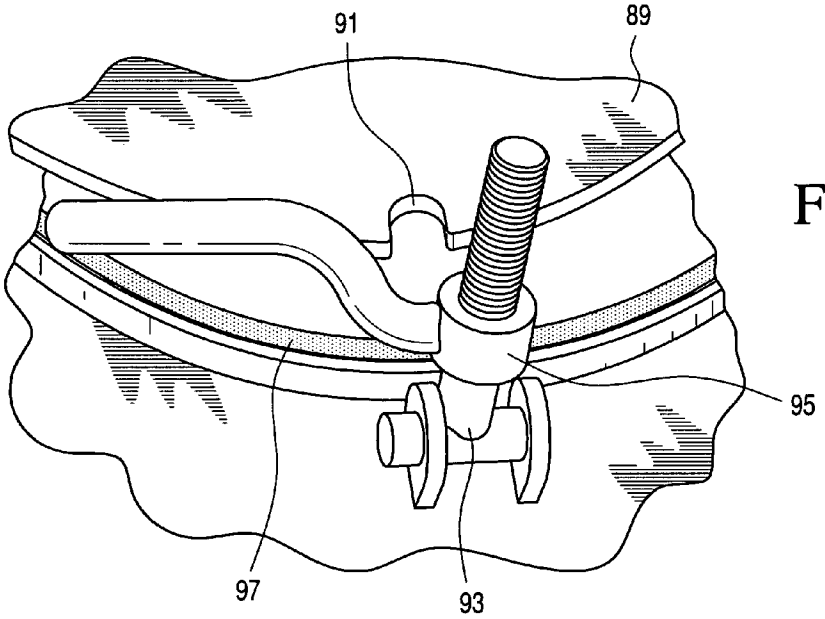
FIG. 7 is a perspective view of the tie-down mechanism for the access hatch cover of the hopper.

Referring to FIGS. 1 and 7, the access hatch cover 89 is provided with slots 91 into which pivot bolts 93 nest to allow nuts 95 to be tightened down against cover 89 and compress a dust seal 97.

Figure 5:
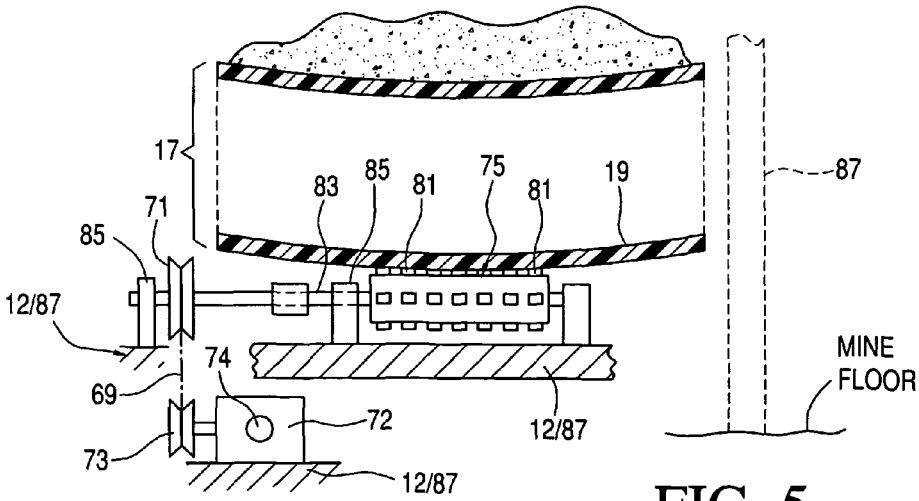
FIG. 5 is a schematic lateral cross-sectional view of a belt conveyor having a power taken-off lagged roller for driving a trickle duster blower.
Figure 6:
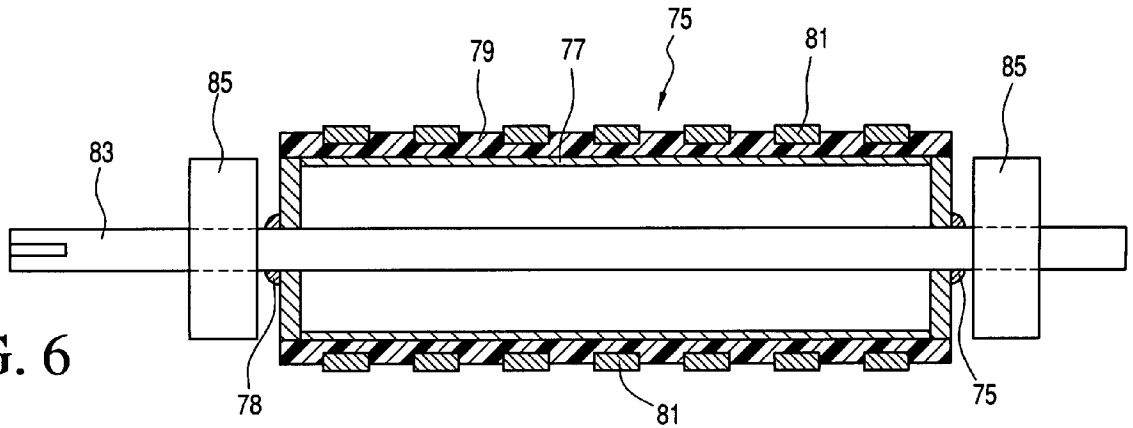
FIG. 6 is a longitudinal cross-sectional view of the roller of FIG. 5.
Figure 8:
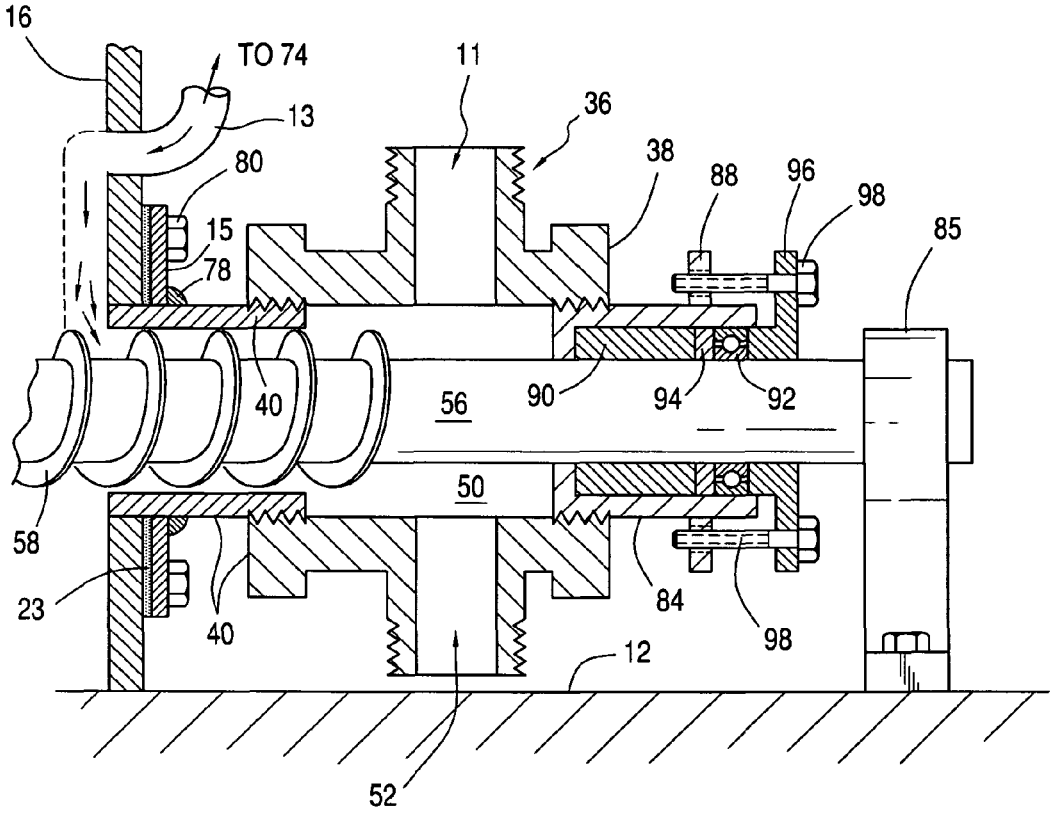
FIG. 8 is a cross-sectional view as in FIG. 1 showing a variation of the bearing mounting for the front end of the auger shaft and for the air inlet part.

An air blower 72 is mounted on either (a) the duster base frame 12 exterior to the hopper, or (b) on the conveyor frame 87 and has a blower exhaust 74 connected into inlet port 11 by hose 13 or equivalent means. This blower preferably is powered by a unique lagged roller system as shown schematically in FIGS. 5 and 6 and comprising roller 75 constructed of a steel roller body 77 having a hard rubber covering (lagging) 79 having ceramic tiles 81 imbedded therein wherein the roller is engaged and driven by the conveyor belt 17, preferably the return run 19 thereof. The roller shaft 83 is mounted in bearings, e.g., pillow blocks 85 affixed to the mine conveyor frame (base) 87. Sheaves 71 and 73 and V belt 69 transmit power from roller 75 to blower 72.

This lagged roller system is designed to counteract the natural tending of a long, heavy stretched conveyor belt to cup downwardly and to place considerable downward pressure on the center portion of conventionally used auxilliary power rollers which are driven by the conveyor belt. This downward pressure actually tends to bend the conventional roller shaft and, in effect, results in fatigue of the steel much like the repeated bending of a nail. The present major shortening of the roller shaft eliminates such metal fatigue, reduces the weight of the roller and allows a lighter weight roller shaft to be used such as to make easier for the worker to make any repairs which might be necessary.

Following is an example of structural dimensions and operating parameters representing the best mode known to applicant for practicing the present invention.

(a) HOPPER CAPACITY—700 LBS.
(b) AUGER SHAFT 2" DIAMETER 1.5 LBS/MIN.
(c) AUGER FLYGHT DIAMETER 2.44 IN.
(d) AUGER PITCH—2 IN.
(e) AUGER SPEED—11 RPM.
(f) AUGER LENGTH—36 INCH OF FLYGHT.
(g) BLOWER MOUNTED ON DUSTER—50 TO 60 CFM AT 5 PSI, 5 HP ELEC. 1,800 RPM., AIR FILTER IN LINE TO DUST DISCHARGE CAVITY.
(h) VIBRATOR CAN PRODUCE 400 LBS OF FORCE.
(i) VIBRATOR IS SET AT 300 LBS OF FORCE.
(j) A FULL HOPPER WILL RUN TO EMPTY IN 8 TO 10 HR.
(k) BLOWER AIR AND DUST MIXED IN DISCHARGE CAVITY AND EJECTED TO DELIVERY HOSE AT ABOUT 1.5 LBS. 1 PER MIN.
(l) DELIVERY HOSE UP TO ABOUT 500 FT. LONG.
(m) HOPPER IS SEALED BY A TOP FILL HATCH COVER.
(n) PUMP TYPE PACKING AROUND AUGER SHAFT.

Operation Procedures

1) Once the pre-operational checks are made, remove the wing nuts from the hatch cover and lay the cover to the side.
2) Add up to 700 lbs of dry rockdust to the hopper, being careful not to introduce any foreign objects such as coal, slate or torn portions of the rockdust bag. Warnings: wet dust may cause the machine to malfunction.
3) Once the hopper is filled, replace the hatch cover and tighten all wing nuts.
4) Assure all by-standers are away from the discharge end of the dusting hose.

5) Press the motor start button on the control panel. This will start the motor and auger. The vibrator will have about a 2 minute delay, will run for 30 seconds, and then repeat the cycle until the machine is shut down. Note: The off-time and run-time of the vibrator can be adjusted. The recommended cycle is 2 minutes off and 30 seconds on. This allows the vibrator to cool.
6) Check the discharge end of the dusting hose to assure that a steady flow of dust is coming out of the hose. If dust is not flowing from the hose shut the machine down and refer to the trouble shooting portion of this manual.
7) Hang the hose as close to the mine shaft top as possible and down-stream of the duster. Point the hose in the direction of the air flow.
8) The duster will discharge up to 90 lbs per hour so the machine will empty in approximately 7-8 hours. When re-filling, de-energize before opening the hatch.
9) Up to 300 feet of 2" rockdust hose may be used. Using hose smaller than 2" or dusting distances more than 300 feet will lead to increased backpressure and will shorten blower life.

The invention has been described in detail with particular reference to preferred embodiments thereof, but it will be understood that variations and modifications will be effected within the spirit and scope of the invention.

I claim:

1. The combination of a power take-off roller having a cylindrical body axially mounted on a shaft which shaft is mounted for rotation on a conveyor supporting base laterally of a longitudinal center axis of said conveyor, a continuous conveyor belt mounted longitudinally on said base wherein said belt is under heavy longitudinal tension and is cupped upwardly from its longitudinal center axis laterally outwardly toward longitudinal edges of said belt, wherein the ratio of the roller length to the belt width is from ⅙ to ½, wherein said body is in contact with said belt along said center axis wherein an end portion of said shaft is provided with a power transfer structure adapted for connection to a driven shaft section of auxiliary equipment, and wherein said roller is a lagged roller having ceramic tiles partially imbedded in its lagged surface.

2. The combination of claim 1 wherein said equipment is an air blower.

* * * * *